US005660450A

United States Patent [19]

Huang

[11] Patent Number: 5,660,450

[45] Date of Patent: Aug. 26, 1997

[54] COMPUTER DESK

[76] Inventor: Huei Mein Huang, No. 23, Su Fun, Su Fun Village, Chi Ku Hsiang, Tainan Hsien, Taiwan

[21] Appl. No.: 591,368

[22] Filed: Jan. 25, 1996

[51] Int. Cl.[6] ..... A47B 35/00

[52] U.S. Cl. ..... 312/194; 108/105; 312/223.5

[58] Field of Search ..... 312/194, 196, 312/351.3, 351.4, 351.8, 223.3; 108/91, 92, 93, 149, 105

[56] References Cited

U.S. PATENT DOCUMENTS

| | | | |
|---|---|---|---|
| 3,104,138 | 9/1963 | Renaud | 312/351.4 X |
| 3,809,449 | 5/1974 | Beaver | 312/194 |
| 4,422,385 | 12/1983 | Rutsche et al. | 312/194 X |
| 4,515,086 | 5/1985 | Kwiecinski et al. | 108/105 X |
| 4,560,215 | 12/1985 | Turner | 312/194 X |
| 5,088,802 | 2/1992 | House | 312/351.8 X |
| 5,101,736 | 4/1992 | Bommarito et al. | 312/194 X |
| 5,357,873 | 10/1994 | Hilton | 108/925 X |
| 5,408,939 | 4/1995 | Lechman | 312/223.3 X |

*Primary Examiner*—Peter M. Cuomo
*Assistant Examiner*—Robert J. Sandy
*Attorney, Agent, or Firm*—Browdy and Neimark

[57] ABSTRACT

A computer desk comprises a desk leg, a desk top comprising a frame and a top board. The frame has two side rods and a cross rod. The top board is provided in the underside thereof with a receiving space in which the frame is secured. The top board is provided in one side of a front segment thereof with a keyboard receiving space and on another side with a flat plate space. The top board is provided in one side of a rear segment thereof with a screen receiving space and on another side with a main machine receiving recess. The desk top is fastened with the desk leg by the two side rods. Two support frames are fastened at the bottom ends thereof with two sides of the desk top. A placing board is fastened with the top ends of the support frames. The keyboard, the screen and the operating unit of the computer are located respectively in the keyboard receiving space, the screen receiving space and the main machine receiving recess. The printer is located on the placing board.

7 Claims, 6 Drawing Sheets

COMPUTER DESK

FIELD OF THE INVENTION

The present invention relates generally to a computer, and more particularly to a computer desk.

BACKGROUND OF THE INVENTION

The conventional computer desk are generally limited in design in that they are not provided with an adequate space for the computer peripheral equipment which are therefore often arranged on the computer desk in a disorderly manner, and that they are not provided with means for locating the computer and its peripheral equipment.

SUMMARY OF THE INVENTION

It is therefore the primary objective of the present invention to provide an improved computer desk enabling its user to operate the computer and the peripheral equipment easily and efficiently.

It is another objective of the present invention to provide an improved computer desk with means for locating the computer and the peripheral equipment.

The foregoing objectives, features and functions of the present invention will be more readily understood upon a thoughtful deliberation of the following detailed description of the present invention in conjunction with the accompanying drawings.

DETAILED DESCRIPTION OF THE INVENTION

Figure 1:
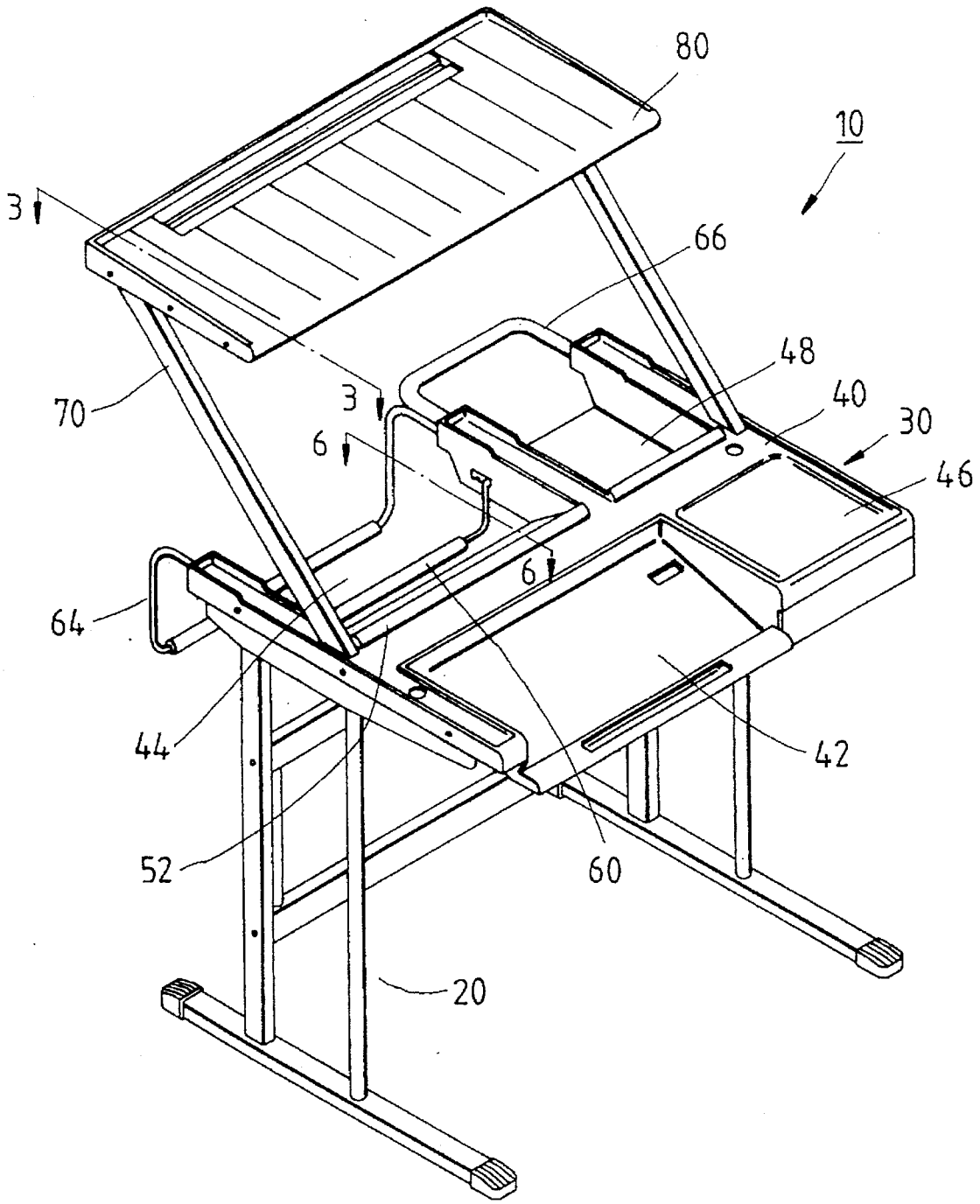
FIG. 1 shows a perspective view of a preferred embodiment of the present invention.
Figure 2:
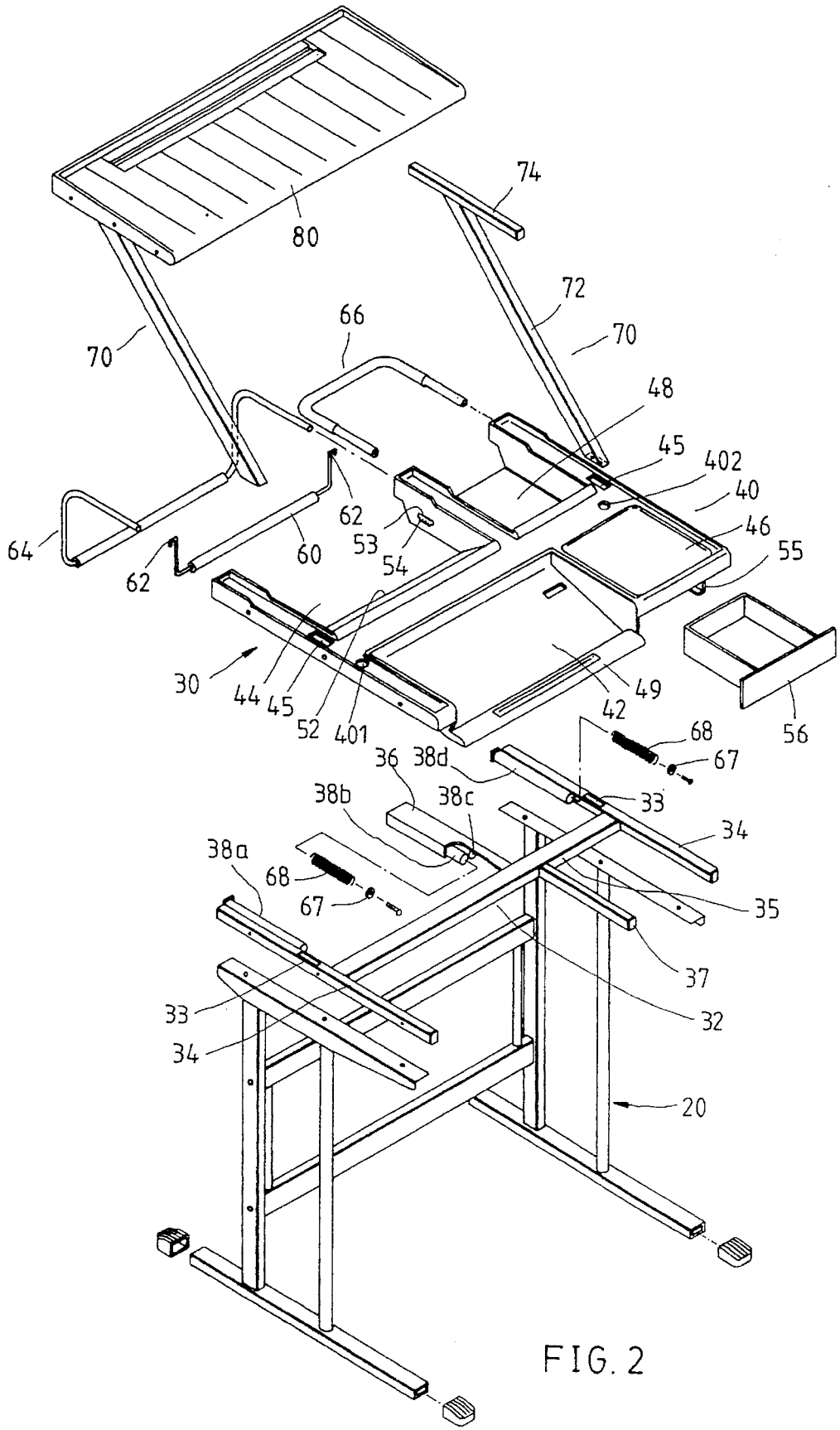
FIG. 2 shows an exploded view of the preferred embodiment of the present invention.

As shown in FIGS. 1 and 2, a computer desk 10 embodied in the present invention comprises the component parts, which are described hereinafter.

A desk leg 20 is formed of rods which are joined together. The desk leg 20 of the present invention may take various forms.

Figure 3:
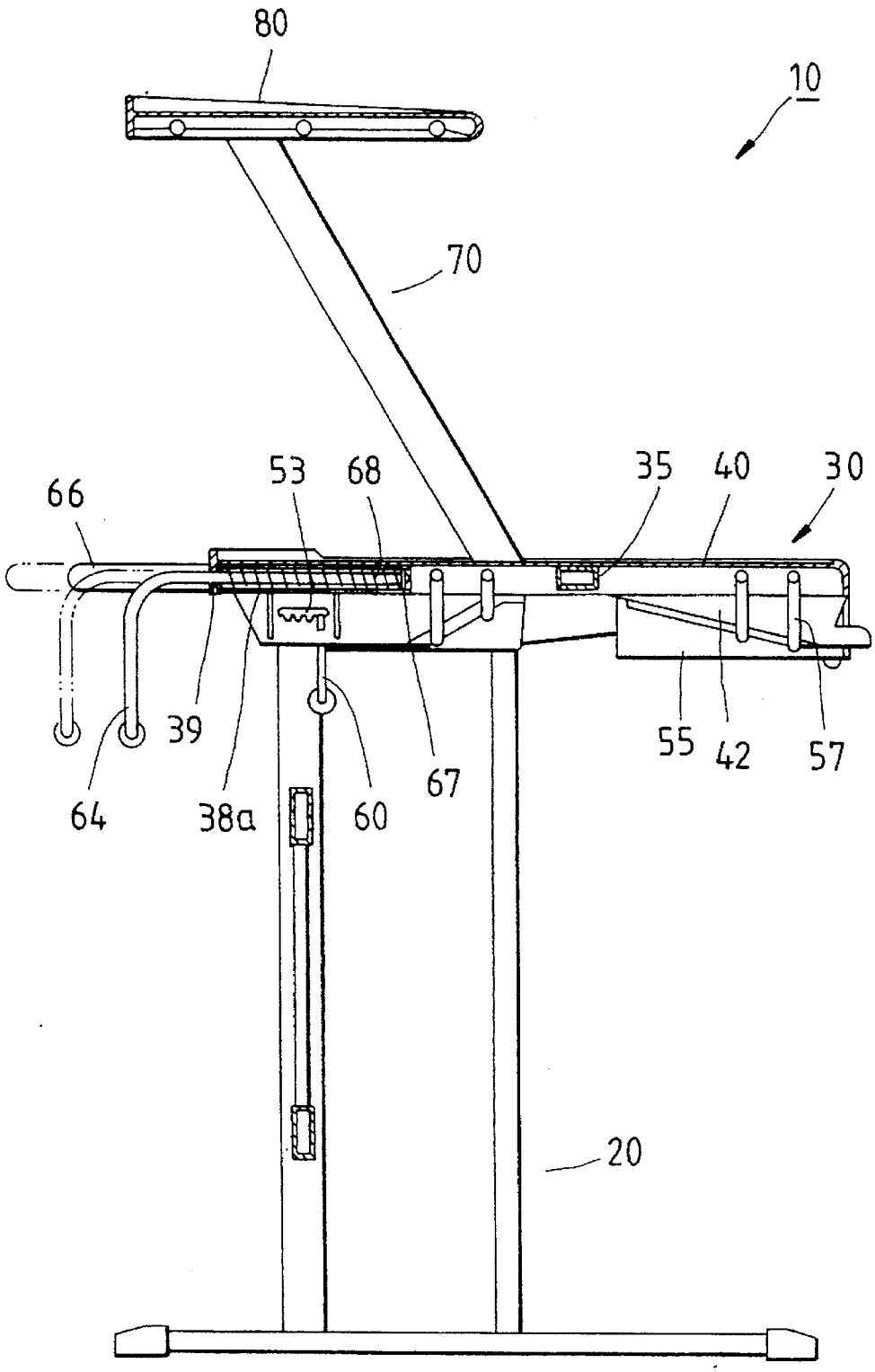
FIG. 3 shows a sectional view of a portion taken along the line 3—3 as shown in FIG. 1.

A desk top 30 comprises mainly a frame 32 and a top board 40. The frame 32 has two side rods 34, a cross rod 35 and an extension rod 36 extending rearwards from the cross rod 35 such that the extension rod 36 is located between two side rods 34. A projection rod 37 is extended forward from the cross rod 35 such that the projection rod 37 is located between two side rods 34. Two tube members 38*a* and 38*d* of four tube members 38 are welded to the inner sides of the rear segments of the two side rods 34. Another two tube members 38*b* and 38*c* are fastened with the extension rod 36. The rear ends of the four tube members 38 are closed and provided with a through hole 39 having a diameter smaller than the inner diameter of the tube members 38, as shown in FIG. 3. Two side rods 34 are provided respectively at the rear segments thereof with a connection portion 33 of a blind hold construction.

Figure 4:
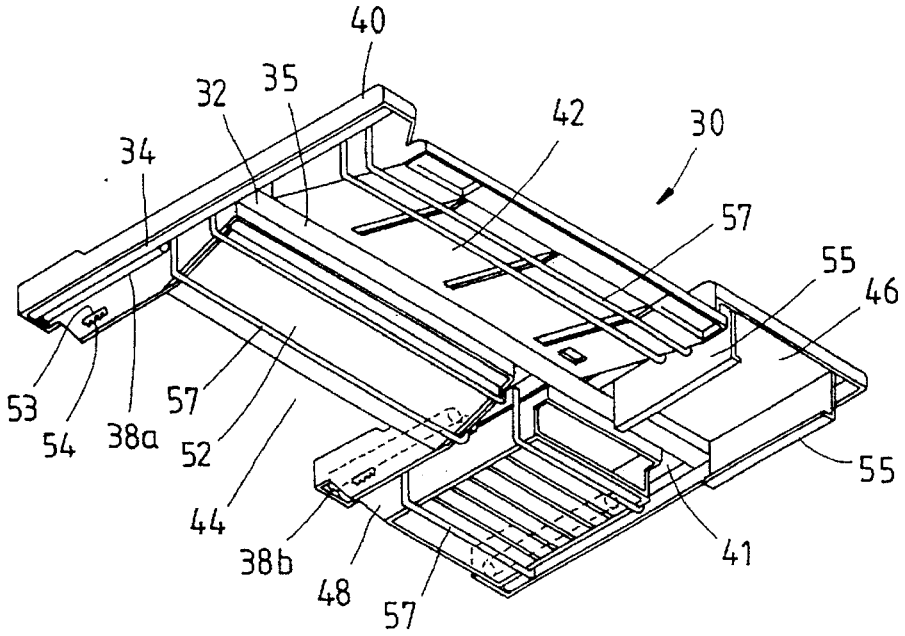
FIG. 4 shows a top view of the desk top of a computer desk embodied in the present invention.
Figure 5:
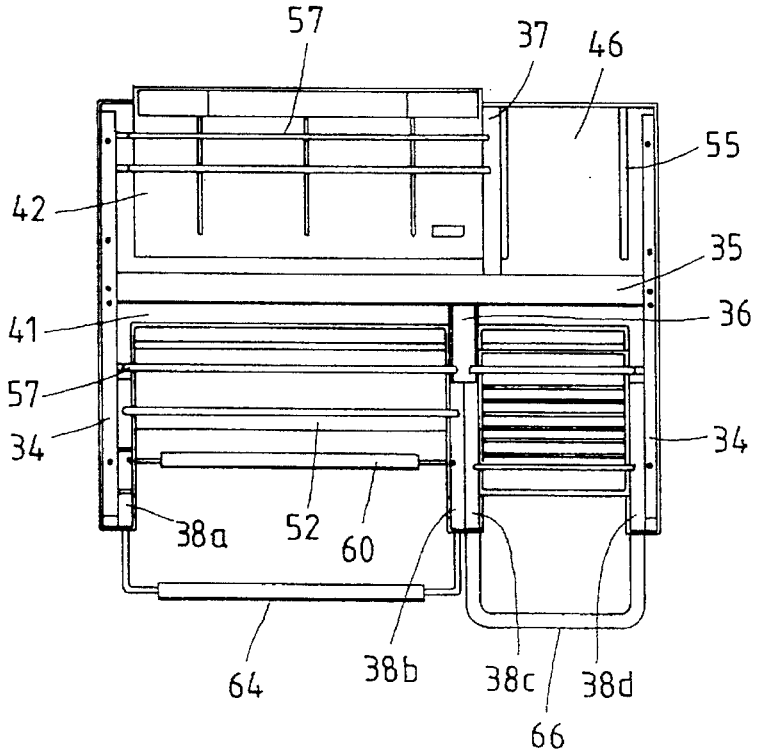
FIG. 5 shows a bottom view of the desk top of the computer desk embodied in the present invention.

The top board 40 is made by injection molding and is provided in the underside thereof with a receiving recess 41 for accommodating an I-shaped rod member, as shown in FIGS. 4 and 5, and corresponding in shape to the side rods 34, the cross rod 35, the extension rod 36 and the projection rod 37 of the frame 32. The top board 40 is provided on the left side of front segment thereof with a slanted keyboard receiving space 42 and is further provided at the left side of the rear segment thereof with a screen receiving space 44. The top board 40 is provided at the right side of the front segment thereof with a flat plate space 46 and is further provided at right side of the rear segment thereof with a main machine receiving recess 48. The keyboard receiving space 42 is provided at the front edge thereof with an arresting edge 49. The screen receiving space 44 is devoid of top, bottom and rear side walls and is provided at the front edge thereof with an oblique plate 52 slanting rearwards and having respectively in two side walls thereof a slot 53 which is provided in the bottom edge thereof with a plurality of locating recesses 54 spaced equidistantly. The top board 40 is provided under the flat plate space 46 thereof with two sliding rails 55 for sliding a drawer 56. The main machine receiving recess 48 is devoid of the rear side. The frame 32 is received in the receiving space 41 of the top board 40 such that two side rods 34 of the frame 32 are located on both sides of the top board 40, and that the cross rod 35 is located between the keyboard receiving space 42, the flat plate space 46 and the screen receiving space 44, the main machine receiving space 48, and further that the extension rod 36 is located between the screen receiving space 44 and the main machine receiving space 48, and still further that the projection rod 37 is located between the keyboard receiving space 42 and the flat plate space 46. The top board 40 is fastened with the side rods 34 of the frame 32 by means of screws. The keyboard receiving space 42, the oblique plate 52 of the screen receiving space 44 and the main machine receiving recess 48 are provided respectively with a plurality of reinforcing ribs 57, which are fastened respectively at both ends thereof between the extension rod 46 and one side rod 34 and between the projection rod 37 and one side rod 34. The reinforcing ribs 57 are horizontally extended along the keyboard receiving space 42, the main machine receiving recess 48 and the bottom edge of the oblique plate 52 for enhancing their structural strength. The desk top 30 is fastened with the desk leg 20 by two side rods 34 of the frame 32.

An angle adjusting rod 60 of a U-shaped construction is provided with two ends curving upwardly and having respectively a hooked portion 62 engageable with the locating recess 54 of the slot 53 of the screen receiving space 44.

Two position restricting members 64 and 66 are of a U-shaped construction. The first position restricting member 64 has both ends which are put through the rear end of the top board 40 such that both ends are received in the tube members 38*a* and 38*b* via the through holes 39 of the tube members 38*a* and 38*b*. There are four arresting pads 67 having an outer diameter smaller than the inner diameter of the tube members 38. The arresting pads 67 are fastened with the free ends of the position restricting members 64 and 66 such that the arresting pads 67 can be moved along with the position restricting members 64 and 66 in the tube members 38. Four compression springs 68 are received respectively in the tube members 38 such that the springs 68 are fitted over the position restricting members 64 and 66, and that both ends of the springs 68 urge against the closed ends of the tube members 38 and the arresting pads 67 of the position restricting members 64 and 66. Without being exerted on by an external force, the elastic force of the springs 68 biases the position of restricting members 64 and 66 into the tube members 38.

Two support frames 70 comprises respectively an upright rod 72 and a connection rod 74 fastened horizontally to the top end of the upright rod 72. Each upright rod 72 has a bottom end which is put through the through hole 45 of the top board 40 of the desk top 30 such that the bottom end is engaged securely with the connection portion 33 of the frame 32 by means of screws.

A placing board 80 has two sides which are fastened with the connection rods 74 of the support frames 70.

In combination, the computer desk 10 has a profile which is shown in FIG. 1.

Figure 7:
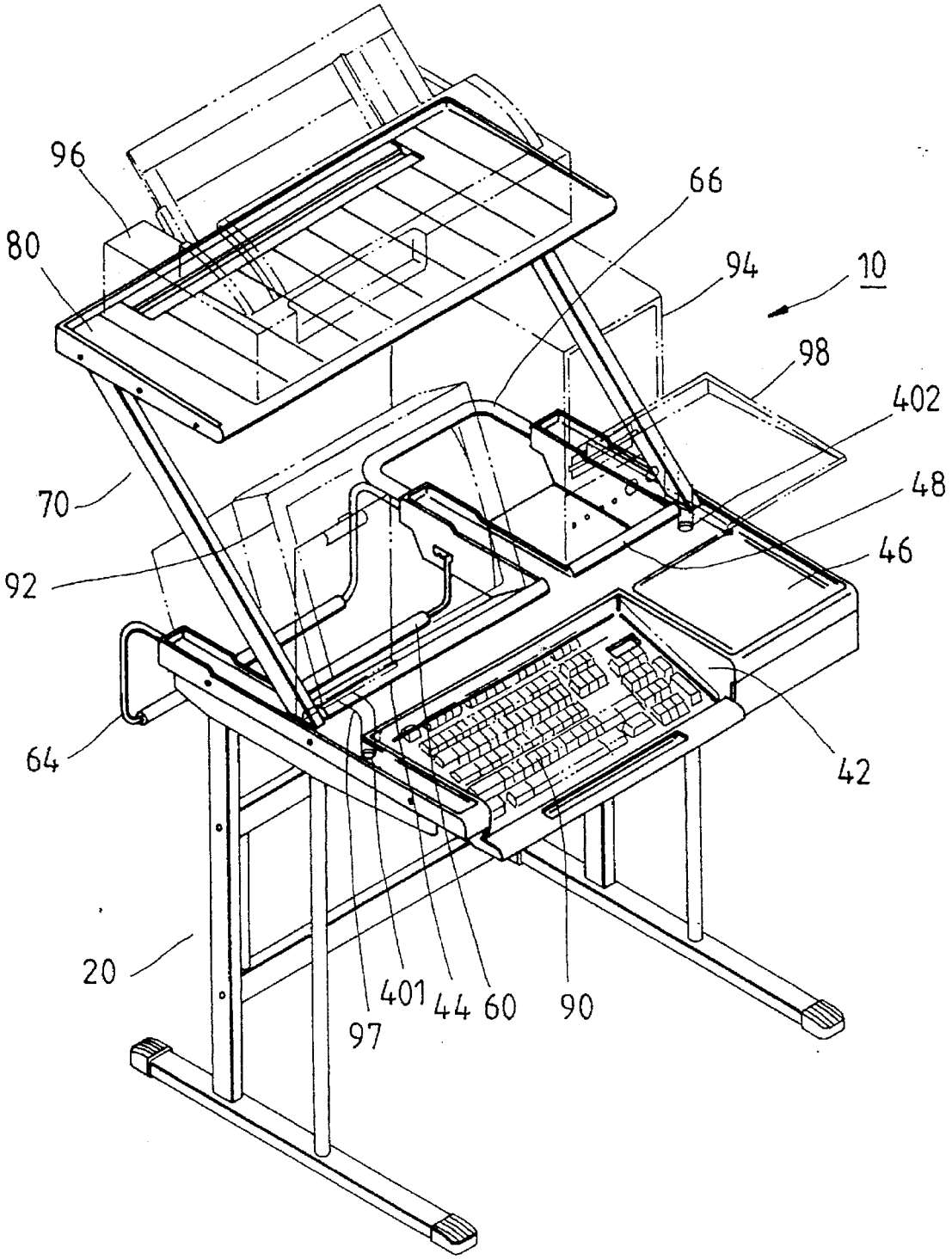
FIG. 7 shows a schematic view of the computer desk of the present invention in use along with the computer and the peripheral equipments.

In operation, the computer and the peripheral equipment are arranged in a manner that is shown in FIG. 7. The keyboard 90 is located at the keyboard receiving space 42 such that the keyboard 90 is stopped by the arresting edge 49. The screen 92 is located at the screen receiving space 44 while the computer 94 is located at the main machine receiving recess 48. The printer 96 is placed on the placing board 80. The flat plate space 46 is intended to locating a mouse. A paper clipping device 97 is located in an insertion hole 401 located in one side of the desk top 30. An article tray 98 is kept in a storage slot 402 located in another side of the desk top 30.

In the process of disposing the screen 92, the first position restricting member 64 is first pulled outwards, as illustrated by the dotted lines in FIG. 3. As a result, the compression spring 68 fitted over the first position restricting member 64 is caused to compress by the arresting pad 67 so as to store an elastic energy. Thereafter, the screen 92 is placed on the screen receiving space 44 such that the bottom edge of the front end of the screen 92 is rested against the oblique plate 52 of the screen receiving space 44, and that the underside of the screen 92 is supported by the angle adjusting rod 90. Finally, the position restricting member 64 is relieved of the pulling force exerting thereon and is then urged by the compression spring 68 to move into the tube member 38 so as to press against the rear end of the screen 92 for locating securely the screen 92. The stored elastic energy enables the position restricting member 64 to remain in the state of urging the screen 92.

The computer operating unit 94 is placed in the main machine receiving recess 48 such that the computer operating unit 94 is urged at the rear end thereof by the second position restricting member 66, which works in a manner similar to that of the first position restricting members 64.

Figure 6:
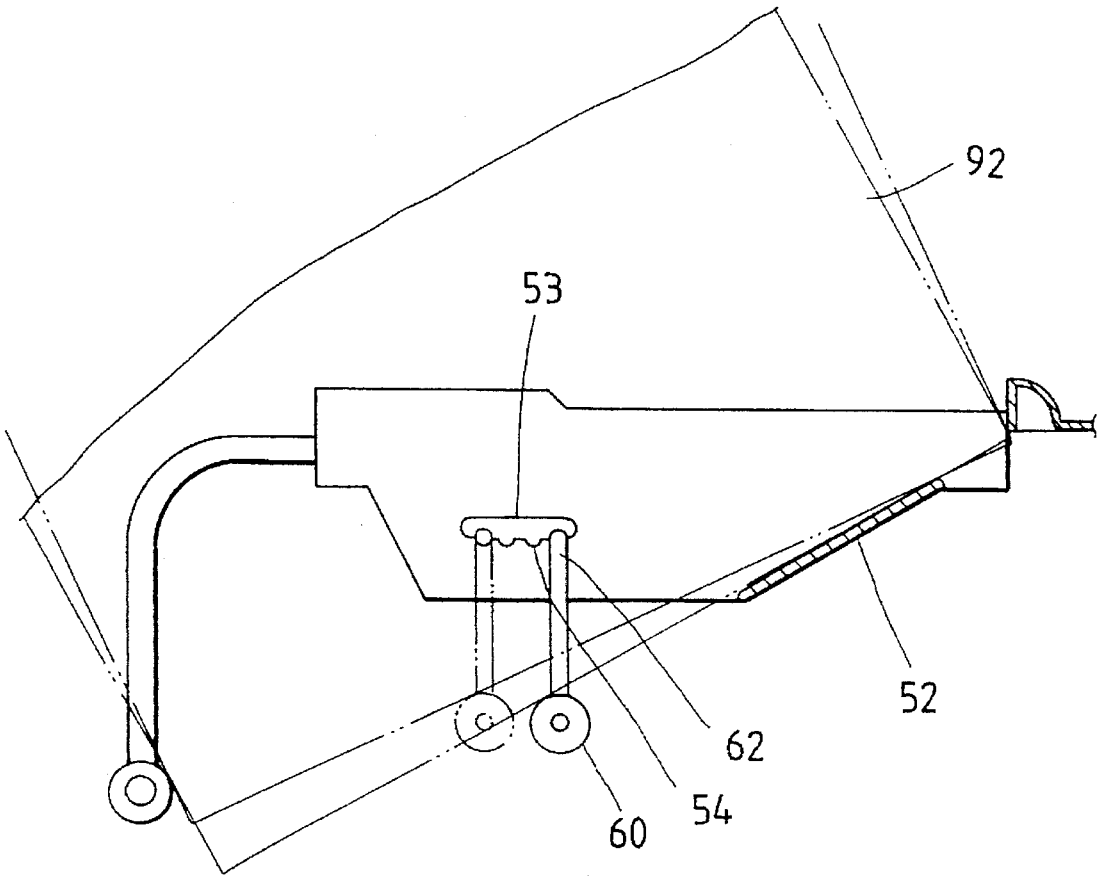
FIG. 6 is a sectional view of a portion taken along the line 6—6 as shown in FIG. 1 to show the state in which the computer screen is adjusted angularly.

As shown in FIG. 6, the underside of the screen 92 is rested on the oblique plate 52 and the angle adjusting rod 60 such that the screen 92 can be so adjusted to position itself in a more steeply inclined position when the adjusting member 60 is engaged with the locating portion 54 which is located farther from the oblique plate 52. As the distance between the adjusting member 60 and the oblique plate 52 is increased, the screen 92 is positioned in a less steeply inclined position.

To sum Up, the computer desk 10 of the present invention has inherent advantages, which are expounded explicitly hereinafter.

The computer desk of the present invention is provided with spaces for disposing and locating the computer and the peripheral equipment in such an organized manner that the operator of the computer has an easy access to the computer as well as the peripheral equipment.

The computer desk of the present invention is provided with means for locating securely the computer and the peripheral equipments.

The computer desk of the present invention is so designed that it is in conformity with the mechanics of the human body and hat it is therefore user-friendly.

The computer desk of the present invention is provided with two position restricting members, which are disposed flexibly so as to enable the computer desk of the present invention to be compatible with the computers of various specifications. In addition, the computer desk of the present invention is provided with means for adjusting the inclination of the computer screen.

What is claimed is:

1. A computer desk, which comprises:

a desk leg;

a desk top comprising a frame and a top board, said frame having two side rods and a cross rod, said top board provided in an underside thereof with a frame receiving recess corresponding in shape to said frame, said top board further provided on one side of a front segment thereof with a slanted keyboard receiving space, said top board still further provided on another side thereof with a flat plate space, said top board still further provided on one side of a rear segment thereof with a screen receiving space and on another side of said rear segment thereof with a main machine receiving recess, said frame being secured to said frame receiving recess such that said two side rods of said frame are located on two sides of said top board and that said cross rod of said frame is located between said keyboard receiving space, said flat plate space and said screen receiving space, said main machine receiving recess, said desk top being fastened with said desk leg by said two side rods of said frame;

two support frames fastened respectively at a bottom end thereof with one side of said desk top; and a placing board fastened at two sides thereof with top ends of said two support frames.

2. A computer desk, which comprises:

a desk leg;

a desk top comprising a frame and a top board, said frame having two side rods, a cross rod, an extension rod extending rearwards from said cross rod, and a projection rod extending forward from said cross rod, said extension rod and said projection rod being located between said two side rods, said top board provided in an underside thereof with a frame receiving space corresponding in shape to said frame, said top board provided on one side of a front segment thereof with a slanted keyboard receiving space and on another side of said front segment with a flat plate space, said top board provided on one side of a rear segment thereof with a screen receiving space and on another side of said rear segment thereof with a main machine receiving recess, said screen receiving space and said main machine receiving recess being respectively devoid of a wall, said frame being secured to said frame receiving space such that said two side rods are located on two sides of said top board, and that said cross rod is located between said keyboard receiving space, said flat plate space, and said screen receiving space, said main machine receiving recess, and further that said extension rod is located between said screen receiving space and said main machine receiving recess, and still further that said projection rod is located between said keyboard receiving space and said flat plate space, said two side rods having respectively a rear segment located outside said screen receiving space and said main machine receiving recess;

a first and a second position restricting members of a U-shaped construction, said first position restricting member being fastened with said side rod and said extension rod located on both sides of said screen receiving space such that said first position restricting member is capable of moving along said side rod and said extension rod, said second position restricting member being fastened with said side rod and said extension rod located on both side of said main machine receiving recess such that said second position restricting member is capable of moving along said side rod and said extension rod;

four elastic elements disposed between each said position restricting member and each said side rod, and between each said position restricting member and each said extension rod, said elastic elements biasing said two position restricting members toward said screen receiving space and said main machine receiving recess at such time when said position restricting members are not exerted on by an external force, said desk top being fastened with said desk leg by said two side rods of said frame;

two support frames fastened at bottom ends thereof with two sides of said desk top; and a placing board fastened at both sides thereof with top ends of said two support frames.

3. The computer desk as defined in claim 2, wherein said frame comprises four tube members, with two of said four tube members being disposed on one side rod and said extension rod located on two sides of said screen receiving space, and with another two of said four tube members being disposed on one side rod and said extension rod located on two sides of said main machine receiving recess, said four tube members having a closed rear end provided with a through hole with a diameter smaller than an inner diameter of said tube members; wherein each of said position restricting members has two free ends provided respectively with an arresting portion having an outer diameter smaller than an inner diameter of said tube members; wherein said two position restricting members have two ends which are received via said through hole of each said tube members in said tube members corresponding in location to said position restricting members; and wherein compression springs are received respectively in said tube members such that said compression springs are fitted respectively over said position restricting members, and that both ends of said compression springs urge respectively the closed end of said tube member and said arresting portion of said portion restricting members.

4. The computer desk as defined in claim 2, wherein said screen receiving space of said top board is devoid of a top wall, a bottom and a rear wall and is provided with a front edge having an oblique plate slanting rearwards and downward, said oblique plate provided respectively in two side walls thereof with a slot which is in turn provided in a bottom edge thereof with a predetermined number of locating portions arranged equidistantly to engage with two hooked portions of an angle adjusting rod.

5. The computer desk as defined in claim 2, wherein said top board is provided under said flat plate space with two rails on which a drawer is mounted.

6. The computer desk as defined in claim 2, wherein said top board is provided in an underside thereof with a plurality of reinforcing ribs located at the positions of said keyboard receiving space, said oblique plate of said screen displaying space and said main machine receiving recess, wherein said reinforcing ribs located under said main machine receiving recess are connected at two ends thereof between said extension rod and a side rod, which are located at both sides of said main machine receiving space, wherein said reinforcing ribs located under said keyboard receiving space are connected at two ends thereof between said projection rod and a side rod, wherein said reinforcing ribs located under said oblique plate of said screen receiving space are connected at two ends thereof between said projection rod and a side rod, wherein said frame is secured to said receiving space of said top board such that said two side rods of said frame are located on two sides of said top board, and that said cross rod is located between said keyboard receiving space, said flat plate space and said screen receiving space, said main machine receiving recess, said desk top being fastened with said desk leg by said two side rods of said frame.

7. The computer desk as defined in claim 2, wherein said two side rods of said frame are provided respectively with a connection portion; wherein said top board is provided respectively on two sides thereof with a through hole in communication with said connection portion; wherein said support frames comprise respectively an upright rod and a connection rod fastened horizontal with a top end of said upright rod, said upright rod having a bottom end which is received in said connection portion via said through hole of said top board; and wherein said placing board is fastened at two sides thereof with said to connection rods.

* * * * *